US005761869A

United States Patent [19]

Tinen et al.

[11] Patent Number: 5,761,869

[45] Date of Patent: Jun. 9, 1998

[54] CEILING GRID WITH BEVEL CONFIGURATION

[75] Inventors: William J. Tinen, Glenview, Ill.; William E. Kirsop, Avon Lake, Ohio; James J. Lehane, Columbia Station; Paul D. LaLonde, Avon, both of Ohio

[73] Assignee: USG Interiors, Inc., Chicago, Ill.

[21] Appl. No.: 773,924

[22] Filed: Dec. 30, 1996

[51] Int. Cl.[6] ..... E04B 9/00

[52] U.S. Cl. ..... 52/506.07; 52/656.9; 52/664; 52/762; 52/763; 52/778; 52/781

[58] Field of Search ..... 52/506.07, 656.9, 52/664, DIG. 8, 762, 763, 778, 781

[56] References Cited

U.S. PATENT DOCUMENTS

| | | | |
|---|---|---|---|
| 3,153,304 | 10/1964 | Evangelista | 52/506.07 X |
| 4,021,986 | 5/1977 | McCall et al. . | |
| 4,505,083 | 3/1985 | Mieyal . | |
| 5,265,393 | 11/1993 | Bischel et al. | 52/506.07 X |
| 5,495,697 | 3/1996 | Bischel et al. | 52/506.07 X |

FOREIGN PATENT DOCUMENTS

| | | | |
|---|---|---|---|
| 1035353 | 4/1953 | France | 52/506.07 |
| 2142356 | 1/1985 | United Kingdom | 52/506.07 |

*Primary Examiner*—Christopher Kent

*Attorney, Agent, or Firm*—Pearne, Gordon, McCoy and Granger LLP

[57] ABSTRACT

A suspension ceiling grid for supporting rectangular panels. The grid members are elongated runners with a generally inverted T-shaped cross-section. Flanges on the lower side of the runners have inclined exposed portions and vertical portions concealed by rabbeted edges of the panels. The flange portions are configured with respect to the proportions of the rabbeted panels, to appear as beveled edges of the panels whereby the finished ceiling appears to be gridless. The runners are specially notched and trimmed to provide a strong but attractive faux miter joint at their intersections.

13 Claims, 3 Drawing Sheets

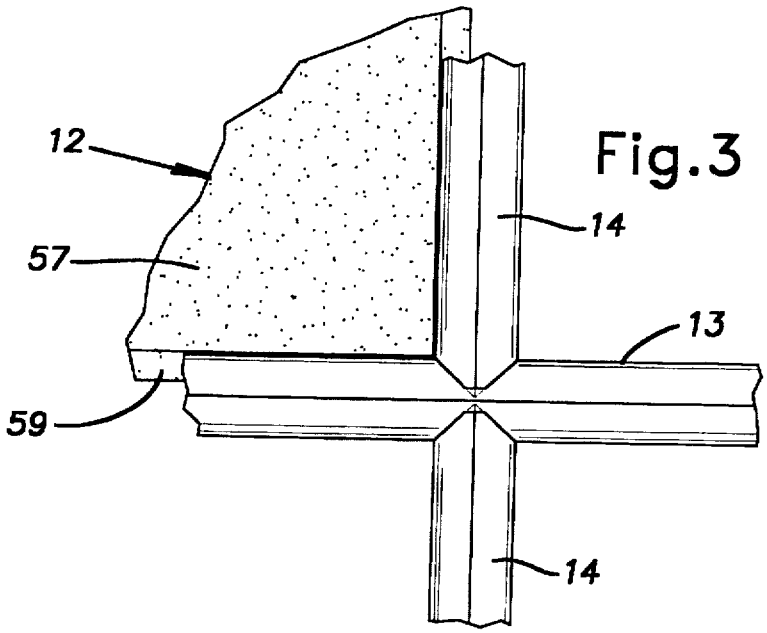
Fig.3
Fig.5
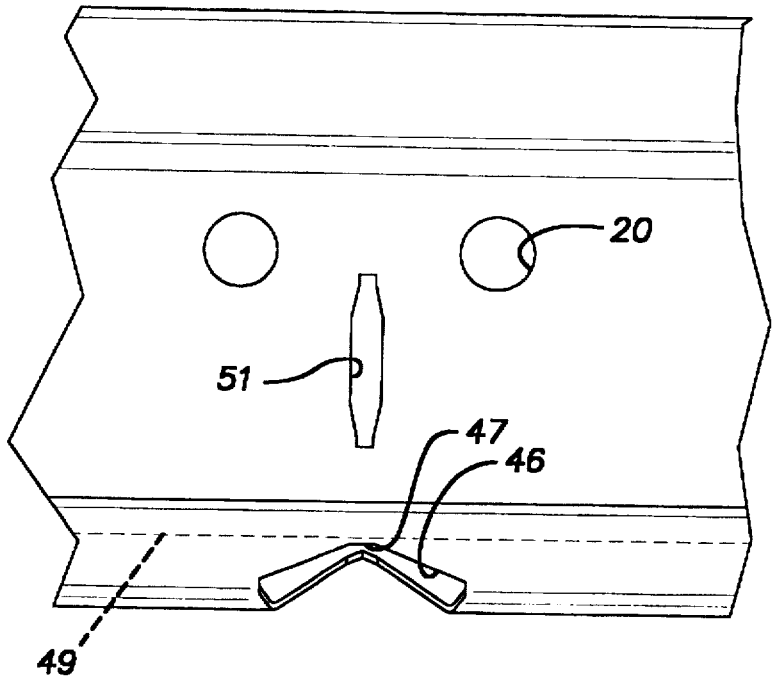
Fig.6
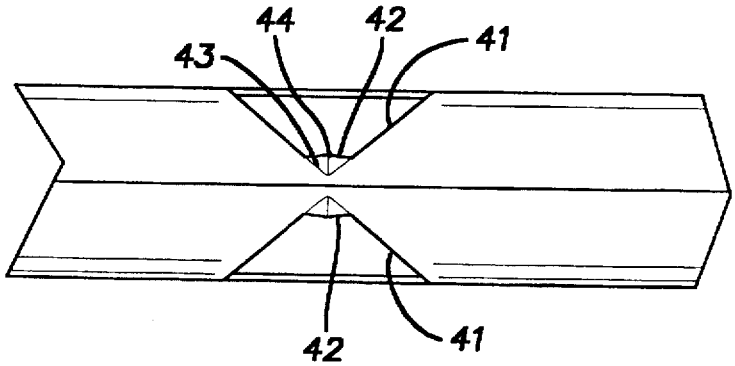

CEILING GRID WITH BEVEL CONFIGURATION

BACKGROUND OF THE INVENTION

Suspension grid systems typically provide grid members interconnected to form rectangular or square openings in which panels are positioned and supported. In most prior art grid systems, the grid members or runners are formed with a cross-section of an inverted "T" and provide a lower or exposed flat surface formed by the oppositely extending flanges on which the panels are supported. In such systems, the assembled grid and panels of the ceiling are a generally planar system in which the panels appear to provide a surface interrupted by a plurality of flat, relatively wide bands. Such systems are extensively used and a need exists for a suspension ceiling system that is distinctive from this common arrangement.

It is known to provide a generally T-shaped grid member with a downwardly open slot shaped to receive T-fasteners which can be positioned in the slot and used to support various equipment or fixtures. Such grid systems are often used in hospitals where patient privacy curtains or other equipment can be mounted on the T-fasteners. An example of such systems is illustrated in U.S. Pat. No. 4,021,986. U.S. Pat. No. 4,505,083 discloses grid runners having a longitudinal recess such as an inverted V-shaped channel in the lower exposed face of the runners and faux miter joints.

SUMMARY OF THE INVENTION

The invention provides a suspended ceiling grid construction that is configured to look like bevelled edges of the panels supported by the grid. The construction thus gives the illusion of a gridless ceiling. The bevelled detail can be used to compliment other architectural bevel features in a building to obtain an integrated motif. As disclosed, the grid is configured to lie flush with the plane of the visible face of rabbeted panels. This configuration contributes to the visual effect in which the grid is perceived to be part of the panels they support.

In the disclosed embodiment, the grid runners are formed of sheet metal rolled into a beam structure with a shape that is described generally as an inverted tee. The sheet metal is bent or folded in a profile symmetrical about a central vertical plane. At the lower part of the profile, the sheet stock diverges from the center plane into flanges that appear as the bevels of the associated panels. The seam between these diverging flanges gives the appearance of a joint between adjacent panels.

In another aspect of the invention, a faux miter joint between intersecting grid runners is formed while maintaining adequate lateral bending strength in a main or through runner. The disclosed flange geometry allows miter notches to be cut into the flanges while sufficient stock remains in these elements at locations that produce a relatively high bending moment of inertia or section modulus. A crease formed in the remaining visible flange material in the through runner transverse to its longitudinal axis improves the appearance of the faux miter joint by visually continuing the center plane seam of the intersecting transverse runners.

BRIEF DESCRIPTION OF THE DRAWINGS

FIG. 3 is a fragmentary bottom view of an intersection of grid runners of the invention;

FIG. 5 is a fragmentary side elevational view of the grid through runner;

FIG. 6 is a fragmentary bottom view of the through runner;

DESCRIPTION OF THE PREFERRED EMBODIMENT

Figure 1:
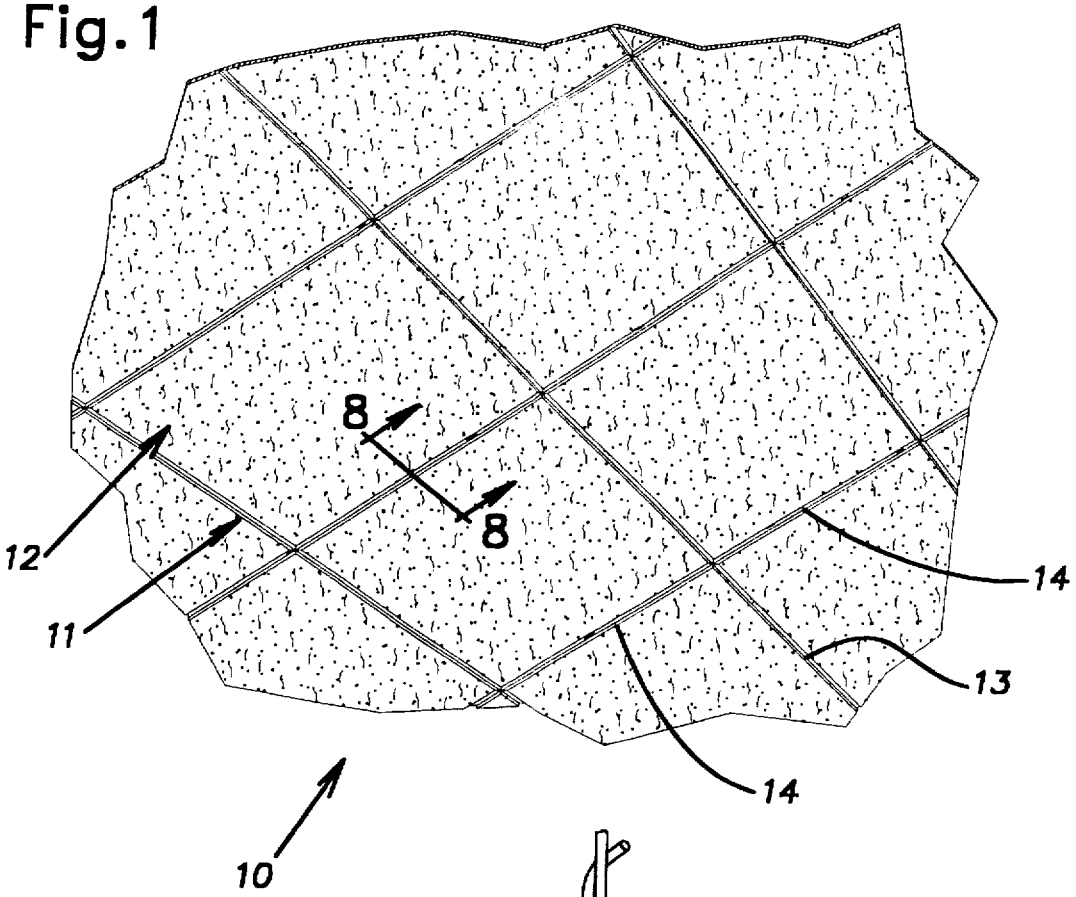
FIG. 1 is a view from below of a suspended ceiling embodying the invention.

Referring now to the figures, there is illustrated a suspended ceiling 10 which comprises a ceiling grid system 11 and ceiling panels 12 supported on the grid. The panels 12, as is conventional, are generally flat and rigid. The grid system 11 includes main or through runners 13 and lateral or transverse runners 14. When installed, each of the runners 13, 14 has a cross-section that can be generally described as an inverted T-shape. At the top of its cross-section, each runner 13, 14, in the illustrated case, has a stiffening bulb or spine 17 which extends longitudinally at the top of a web element or portion 18. The web portion 18 is generally vertically disposed in the installed condition of the respective runner 13, 14. The main or through runners 13 are supported from a structural ceiling by support wires 19, for example, each extending through a selected one of apertures 20 provided in the webs 18 of the main runners 13. Unitary with the web portion 18 at its lower edge are first and second oppositely extending flanges 21, 22. The flanges 21, 22 extend longitudinally along essentially the full length of the respective runners 13, 14. Each of the flanges 21, 22 includes an inclined generally planar portion 23, 24 proximal to the web 18 and a generally planar vertical portion 26, 27 distal from the web 18. The flanges 21, 22 further include an in-turned reinforcing lip 31, 32. The inclined portions 23, 24, vertical portions 26, 27 and lip portions 31, 32 of the first and second flanges 21, 22, respectively, are integral with one another. As shown, the flanges 21, 22 are symmetrical with one another about an imaginary central vertical plane passing through the web portion 18.

In the illustrated example, the inclined portions 23, 24 of the flanges 21, 22 rise from the horizontal at an angle of about 40°. The vertical portions 26, 27 rise, from corners 30 with the respective inclined portions 23, 24, substantially higher than an imaginary horizontal plane where the inclined portions 23, 24 intersect the web 18 and, it will be seen, at least the majority of the height of the flange lip portions 31, 32 lie above this imaginary plane. The lips 31, 32 serve to reinforce the vertical flange portions 26, 27.

Preferably, the stock for forming the runners 13, 14 is sheet steel that is roll-formed into the illustrated generally T-shaped structure. When fabricated in this manner, the main body of the runners is unitary and the web 18 is comprised of two layers 33, 34. The layers 33, 34 form a seam 36 between the inclined portions of the flanges 23, 24.

Commonly, a ceiling grid structure is constructed by suspending relatively long "main" runners in parallel rows. Typically, the main runners are long pieces, i.e. 12 feet in length, that are joined end-to-end to form of a continuous row. Between the main runners, cross-runners of a limited length are assembled into slots in the webs of the main runners. The cross or transverse runners may have a length of, for example, 4 feet. 4 foot×4 foot grid modules formed by the main runners and the transverse runners can be divided into 2 foot×2 foot modules or 1 foot×1 foot modules or into rectangular modules by adding secondary cross runners. The main runners and primary and secondary cross runners can have webs of different height so as to provide sufficient vertical beam strength. Another known way of constructing a suspended ceiling is to assemble runners in a basket weave pattern. In either the main runner/cross runner construction or in the basket weave construction, there is a "through" runner that runs through an intersection and opposed cross or transverse runners that abut the through runner at a common intersection from opposite sides of the through runner. The terms main or through runner are used interchangeably herein to designate the runner which passes through an intersection and the terms cross or transverse runners are used to designate runners which abut a main or through runner but which do not pass continuously through an intersection.

Figure 2:
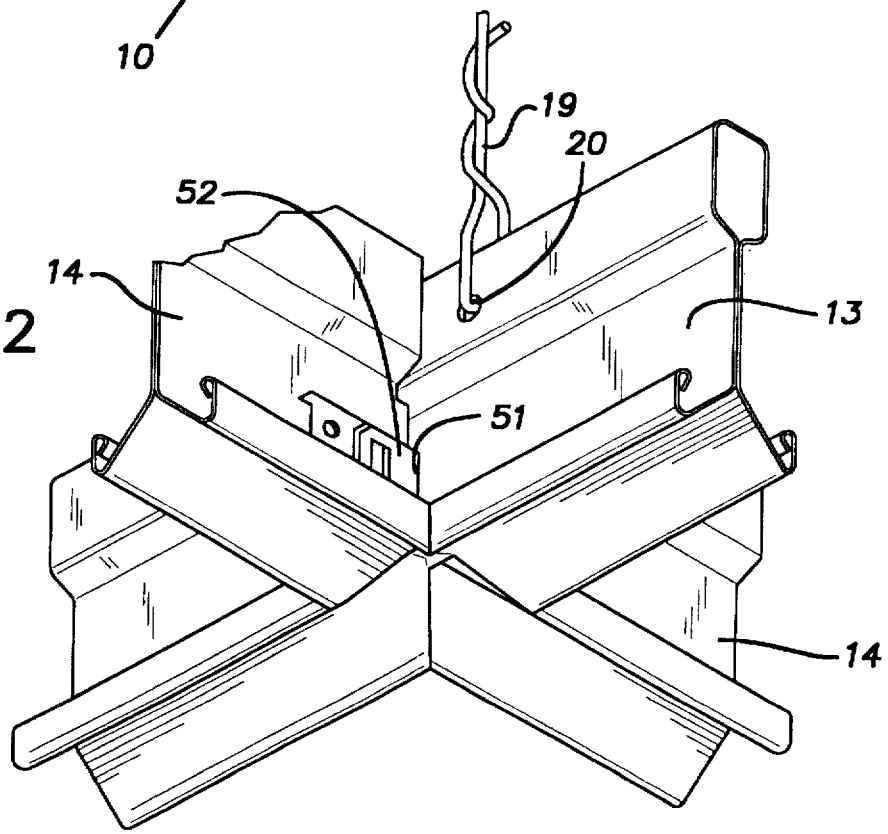
FIG. 2 is a fragmentary perspective view from below of an intersection of grid runners constructed in accordance with the invention.
Figure 4:
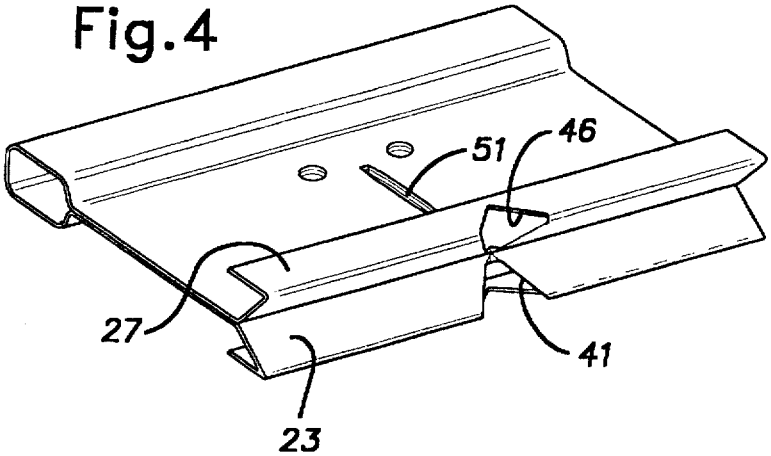
FIG. 4 is a fragmentary perspective view from below of a grid through runner.

The invention provides a faux miter joint at intersections between the main or through runner 13 and opposed cross-runners 14 as best shown in FIGS. 2 and 3. At the mitered joint, the through runner is cut or notched through its flanges 21, 22 to receive ends 39 of the cross-runners 14. The notches or holes 41 have a generally triangular configuration both in the plane of the inclined portion 23, 24 of the respective flange and in the vertical portion 26, 27 of the respective flange. A triangular zone or area 41 of the hole or notch in the inclined flange portion 23, 24 has its apex truncated at 42 to leave material or stock 43 in the inclined flange portion 23 immediately adjacent the seam 36. This material stock 43 leaves the through runner 13 with lateral bending strength in this area. The material stock 43, on both sides of the seam 36, is stamped or otherwise formed with a transverse crease 44. The transverse crease 44, which lies in a horizontal plane on both sides of the seam 36, enhances the illusion of a true miter by continuing the sight line of the seams 36 of the cross-runner ends 39.

A triangular portion 46 of the hole or notch in the vertical flange portions 26, 27 extends, preferably, vertically above an imaginary horizontal plane through the intersection of the inclined flange portions 23 with the web 18. Preferably, however, an apex 47 of this triangular portion 46 lies a substantial vertical distance below an upper edge 48 of the vertical flange portion 26, 27. It will be understood that, ideally, the apex 47 is slightly below a lower edge 49 of the respective reinforcing lip 31, 32. This assures that the reinforcing lips 31, 32 are not diminished in their strengths by the presence of a part of the notch portion 46.

A vertically elongated hole 51 is punched through the web 18 at an imaginary vertical plane transverse to the web 18 and bisecting the triangular notch portions 41 and 46. The hole 51 receives end connectors 52 assembled or otherwise formed on ends 39 of the cross-runners 14. The connectors 52 may be of the type disclosed in U.S. Pat. No. 5,517,796 or of other known types.

Figure 7:
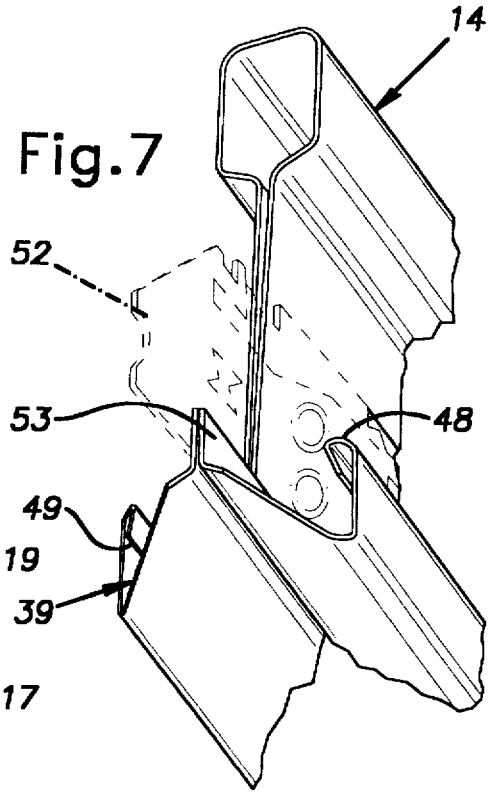
FIG. 7 is a fragmentary perspective view of an end of a cross-runner with an end connector shown in phantom.

The ends 39 of each of the cross-runners 14 are trimmed to fit the miter notch area 41, 46 in the through runner 13. As shown in FIG. 7, the inclined flange portions 23, 24 at the cross-runner end 39 extend beyond remaining parts of the cross-runner except for the connector 52 and a small vertical remainder 53 of the web layers 33, 34 above the plane of intersection of the inclined flange portions 23, 24 and the web 18. This small vertical remainder 53 ensures that the adjacent area of the seam 36 when viewed from below is uniform in appearance along the full length of the cross-runner 14 and minimizes the risk that a gap could form or be perceived at the seam area at the cross-runner end 39. The vertical remainder 53 is accommodated by the height of the apex 47 of the triangular notch portion 46. Assembly of the connectors 52 into the hole 51 is described in aforementioned U.S. Pat. No. 5,517,796.

Figure 8:
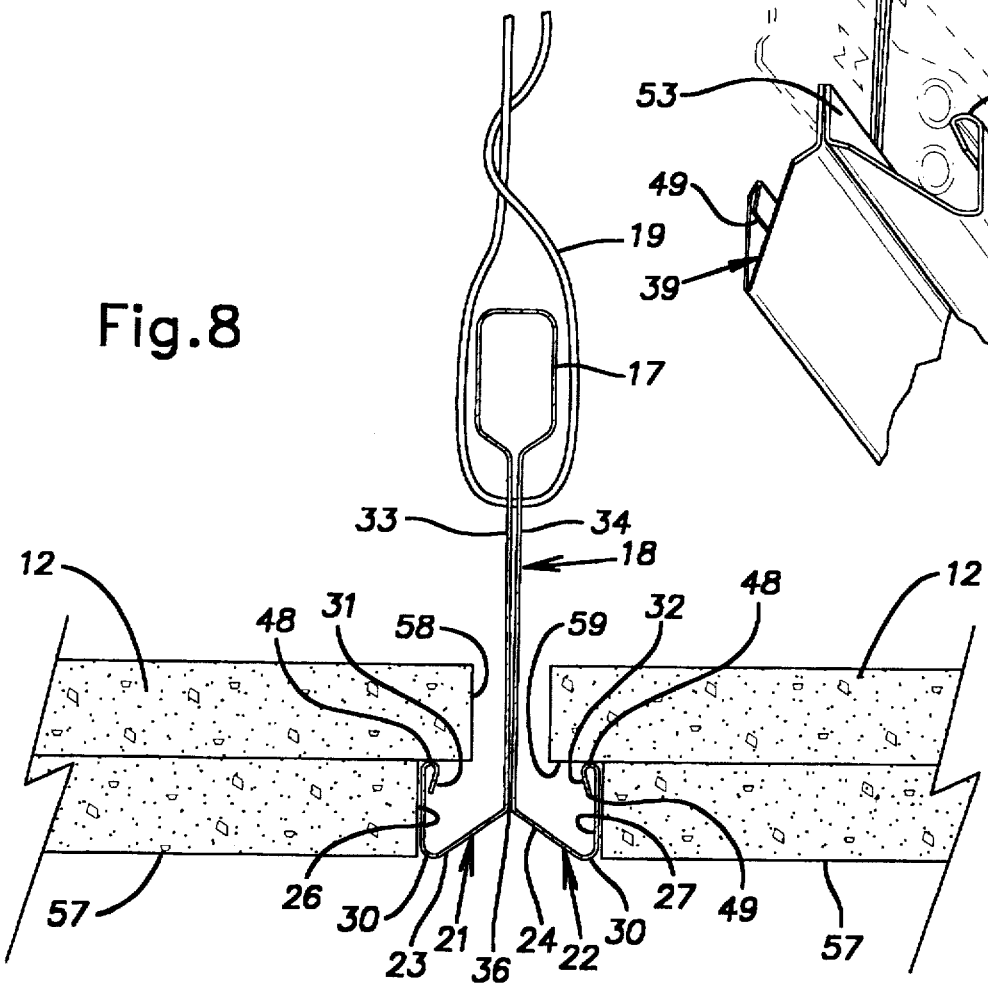
FIG. 8 is a cross-sectional view of the ceiling taken in the plane indicated at the line 8—8 in FIG. 1.

Study of FIG. 8 shows the relationship of rabbeted panels 12 assembled in and supported by the grid 11. The panels 12 have a lower planar visible face 57 surrounded by a rabbeted peripheral edge 58. The edges have a face or shelf 59 that is recessed vertically above the visible face 57 a distance generally equal to the vertical height of the second flange portion 26, 27. The visible faces 57 are proportioned to fit relatively closely in the space between opposed second flange portions 26, 27 of parallel spaced grid runners so that the second flange portions 26, 27 are concealed by the panels 12 and the first flange portions 23, 24 of the runners 13, 14 appear as beveled edges of the panels. This illusion is augmented by the fact that a lower extremity of the runners 13, 14 formed at the juncture of the inclined flange portion 23, 24 and vertical flange portion 26, 27 is generally coplanar with the plane of the lower visible face 57 of the panels 12.

The vertical height of the web 18 measured from the bulb 17 to its intersection with the inclined flange portion 23, 24 is greater than that ordinarily found in standard grid tees and other known constructions. Such standard and other known constructions can be compared, for example, with the grid of the present invention by reference to, i.e. standardizing, the distance between the bulb and the visible face of the panel supported by the grid. As a result, the grid of the present invention can be made from lighter gage stock while providing the same beam strength.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A suspended ceiling grid system for supporting ceiling panels comprising elongated through runners and cross-runners each being roll formed of sheet metal and having a vertical web, lying in a vertical plane and having a lower edge, and panel supporting flanges integrally joined to the lower edge of the vertical web, the flanges extending laterally from opposite sides of the web and being symmetrical with respect to the web, the flanges each having a first portion extending downwardly and laterally outwardly from the plane of the web to a corner and a second portion extending generally vertically upwardly from the corner.

2. A suspended ceiling grid system as set forth in claim 1, wherein the second portion of each flange extends vertically upwardly above an imaginary horizontal plane passing through an upward extremity of the first portion of each flange.

3. A suspended ceiling grid system as set forth in claim 1, wherein said grid through runners have holes in said webs to receive connectors of intersecting grid cross-runners, the ends of said cross-runners having connectors received in the connector receiving holes of the through runner from opposite sides thereof.

4. A suspended ceiling grid system as set forth in claim 3, wherein said first and second flange portions of said through runner are notched symmetrically with an imaginary vertical plane passing through said connector receiving hole, the flanges of the cross-runners having ends cut to a shape to fit the notches of the flanges of the through runner.

5. A suspended ceiling grid system as set forth in claim 1, wherein said second portions of said flanges each have a distal edge remote from its associated first portion and each have a reinforcing lip formed by a reverse bend adjacent its distal edge.

6. A suspended ceiling grid system as set forth in claim 5, wherein said lip is between said second flange portion and said web.

7. A suspended ceiling grid system as set forth in claim 4, wherein said second portion of said flange has a distal edge remote from its associated first portion and a reinforcing lip formed by a reverse bend adjacent the distal edge of said second flange portion, said notch in said second flange portion being configured to leave said reinforcing lip intact.

8. A suspended ceiling grid system as set forth in claim 4, wherein the notches in said first flange portion are configured to leave a zone of material adjacent said web to maintain lateral bending strength.

9. A suspended ceiling grid system as set forth in claim 8, wherein said through runner has a longitudinal axis and said zone of material is creased along a line transverse to the longitudinal axis of the through runner to appear as a continuation of a line between the flanges of the intersecting cross-runners.

10. A suspended ceiling grid system as set forth in claim 1, wherein said first flange portion is generally planar.

11. A suspended ceiling grid system as set forth in claim 10, wherein the plane of said first portion is at an inclination from horizontal of about 40°.

12. A suspended ceiling grid system as set forth in claim 4, said cross-runners have end portions that are trimmed so that said webs are notched in a manner leaving a lower part of the web immediately above the flanges existing and the notches in the through runner are adapted to receive said lower part of the web of an intersecting cross-runner.

13. A suspended ceiling comprising a grid of intersecting runners that form rectangular openings, the grid being adapted to be suspended from a superstructure, and rigid, generally planar panels assembled in the rectangular openings, the runners being elongated members having a cross-section generally shaped as an inverted tee, the cross-section including a web in a generally vertical plane and a pair of symmetrical flanges adjacent a lower edge of the web and being disposed on opposite sides of the plane of the web and extending laterally in opposite directions, the flanges having a first portion extending downwardly and laterally outwardly from the plane of the web to a corner and a second portion with a vertical height extending generally upwardly from the corner to a panel supporting surface, said panels each having a lower visible face surrounded by a rabbeted peripheral edge, the rabbeted edges being recessed vertically above the visible face a distance generally equal to the vertical height of the second flange portion of the runner, the visible faces of the panels being proportioned to fit relatively closely in a space between opposed second flange portions of parallel spaced grid members whereby the second flange portions are substantially fully concealed by the panels and the first flange portions of the runners appear as beveled edges of the panels.

* * * * *